US008979514B2

(12) United States Patent
Furuhashi et al.

(10) Patent No.: US 8,979,514 B2
(45) Date of Patent: Mar. 17, 2015

(54) PUMP PRESSURE CONTROL VALVE WITH SHOCK REDUCTION FEATURES

(75) Inventors: Tsutomu Furuhashi, West Bloomfield, MI (US); Dhyana Ramamurthy, Novi, MI (US); Joseph Lubinski, South Lyon, MI (US); Rebecca Spence, Novi, MI (US)

(73) Assignees: DENSO International America, Inc., Southfield, MI (US); Denso Corporation, Kariya-shi, Aichi-ken (JP)

( * ) Notice: Subject to any disclaimer, the term of this patent is extended or adjusted under 35 U.S.C. 154(b) by 583 days.

(21) Appl. No.: 13/355,963

(22) Filed: Jan. 23, 2012

(65) Prior Publication Data

US 2012/0251367 A1 Oct. 4, 2012

Related U.S. Application Data

(60) Provisional application No. 61/469,506, filed on Mar. 30, 2011.

(51) Int. Cl.

| | |
|---|---|
| ***F04B 49/22*** | (2006.01) |
| ***F04B 53/10*** | (2006.01) |
| ***F02M 55/04*** | (2006.01) |
| ***F02M 59/36*** | (2006.01) |
| ***F04B 7/00*** | (2006.01) |
| ***F04B 11/00*** | (2006.01) |

(52) U.S. Cl.

CPC ..... *F02M 55/04* (2013.01); *F02M 59/368* (2013.01); *F04B 7/0053* (2013.01); *F04B 11/00* (2013.01); *F04B 53/1082* (2013.01); *F02M 2200/306* (2013.01)

USPC ..... 417/505

(58) Field of Classification Search

CPC ..... F02M 59/366–59/368

USPC ..... 417/470, 471, 505, 415, 446, 298, 540; 137/565.16; 251/82, 83

See application file for complete search history.

(56) References Cited

U.S. PATENT DOCUMENTS

| | | | | |
|---|---|---|---|---|
| 6,345,608 | B1 | 2/2002 | Rembold et al. | |
| 6,357,519 | B1 | 3/2002 | Ozaki et al. | |
| 7,540,274 | B2 | 6/2009 | Yamada et al. | |
| 2010/0166584 | A1 * | 7/2010 | Fukui et al. | 417/505 |

FOREIGN PATENT DOCUMENTS

| | | |
|---|---|---|
| JP | 2008-304168 | 12/2008 |

OTHER PUBLICATIONS

Office Action dated Oct. 20, 2014 in the corresponding DE application No. 102012102561.4 with English translation.

* cited by examiner

*Primary Examiner* — Bryan Lettman

(74) *Attorney, Agent, or Firm* — Harness, Dickey & Pierce, P.L.C.

(57) ABSTRACT

A pump includes a pump casing defining a first chamber and a second chamber, and fluid moves from the first chamber to the second chamber during a stroke. The pump also includes a needle that is movably disposed in the first chamber and a valve carriage that is movably disposed in the second chamber. The valve carriage includes an internal stop, and the valve carriage also includes a cavity therein that is partially defined by the internal stop. The pump further includes a valve that is movably disposed within the cavity of the valve carriage, and the valve is operable to be impacted by the needle during the stroke. Also, the needle is operable to impact the valve carriage during the stroke. Moreover, the valve is operable to impact the internal stop during the stroke at a time different from the needle impacting the valve carriage.

20 Claims, 6 Drawing Sheets

PUMP PRESSURE CONTROL VALVE WITH SHOCK REDUCTION FEATURES

CROSS-REFERENCE TO RELATED APPLICATIONS

This application claims the benefit of U.S. Provisional Application No. 61/469,506 filed on Mar. 30, 2011. The entire disclosure of the above application is incorporated herein by reference.

FIELD

The present disclosure relates to a pump pressure control valve and, more particularly, to a pump pressure control valve with shock reduction features.

BACKGROUND

This section provides background information related to the present disclosure which is not necessarily prior art. Some modern internal combustion engines, such as engines fueled with gasoline, may employ direct fuel injection, which is controlled, in part, by a gasoline direct injection pump. While such gasoline direct injection pumps have been satisfactory for their intended purposes, a need for improvement exists. One such need for improvement may exist in the control of a pressure control valve. In operation, internal parts of a pressure control valve may come into contact with adjacent parts, which may cause noise that is audible to a human being standing a few feet (e.g. 3 feet or about 1 meter) away from an operating direct injection pump. Thus, improvements in method(s) of control to reduce audible noise of a gasoline direct injection pump are desirable.

SUMMARY

This section provides a general summary of the disclosure, and is not a comprehensive disclosure of its full scope or all of its features.

A pump having a stroke for moving a fluid is disclosed. The pump includes a pump casing defining a first chamber and a second chamber, and the fluid moves from the first chamber to the second chamber during the stroke. The pump also includes a needle that is movably disposed in the first chamber and a valve carriage that is movably disposed in the second chamber. The valve carriage includes an internal stop, and the valve carriage also includes a cavity therein that is partially defined by the internal stop. The pump further includes a valve that is movably disposed within the cavity of the valve carriage, and the valve is operable to be impacted by the needle during the stroke. Also, the needle is operable to impact the valve carriage during the stroke. Moreover, the valve is operable to impact the internal stop during the stroke at a time that is different from the needle impacting the valve carriage.

Additionally, a pump having a suction stroke for moving a fluid is disclosed. The pump includes a pump casing defining a first chamber and a second chamber, and the fluid moves from the first chamber to the second chamber during the suction stroke. The pump further includes a needle that is movably disposed in the first chamber and a valve carriage that is movably disposed in the second chamber. The valve carriage includes an internal stop, and the valve carriage also includes a cavity therein that is partially defined by the internal stop. A sleeve opening is defined in the valve carriage and provides access to the cavity. Furthermore, the pump includes a fluid passageway defined through the valve carriage, and the fluid passageway including a valve seat. The pump also includes a valve that is movably disposed within the cavity to seat on and unseat from the valve seat to control flow of the fluid into the cavity. The valve is operable to protrude partially from the sleeve opening. The needle is operable, during the suction stroke, to move toward the valve and the valve carriage and eventually impact the valve. Also, the needle is operable, during the suction stroke and after impacting the valve, to advance the valve into the cavity and unseat the valve from the valve seat. Furthermore, the needle is operable, during the suction stroke and after unseating the valve from the valve seat, to impact the valve carriage. Moreover, the valve is operable, during the suction stroke and after the needle impacts the valve carriage, to advance further into the cavity and impact the internal stop.

Still further, a vehicle fuel pump having a suction stroke and a pump stroke for moving a fuel is disclosed. The pump includes a pump casing defining a first chamber, a second chamber, a third chamber, and a fourth chamber. The pump also includes a needle that is movably disposed in the first chamber and that is biased toward the second chamber. Movement of the needle is selectively controlled by a solenoid. The pump also includes a valve carriage that is movably disposed in the second chamber. The valve carriage includes an internal stop, and the valve carriage also includes a cavity therein that is partially defined by the internal stop. A sleeve opening is defined within the valve carriage and provides access to the cavity. The pump also includes a first fluid passageway defined through the valve carriage, and the first fluid passageway includes a valve seat. A second fluid passageway is also defined through the internal stop. The pump also includes a valve that is movably disposed within the cavity and that is biased to seat against the valve seat and to protrude partially from the sleeve opening. The pump also includes a plunger that is movably disposed within the third chamber and a check valve that controls flow from the third chamber to the fourth chamber. The needle is operable, during the suction stroke, to move toward the valve and the valve carriage and eventually impact the valve. The needle is also operable, during the suction stroke, to advance the valve into the cavity and unseat the valve from the valve seat after impacting the valve. The needle is further operable, during the suction stroke, to impact the valve carriage after unseating the valve from the valve seat. The valve is operable, during the suction stroke, to advance further into the cavity and impact the internal stop after the needle impacts the valve carriage. The plunger is operable, during the suction stroke, to move within the third chamber to draw fuel along a flow path extending from the first chamber, through the first fluid passageway, through the cavity, through the second fluid passageway, and into the third chamber. Moreover, the check valve is operable, during the suction stroke, to prevent flow of fuel from the third chamber into the fourth chamber. The solenoid is operable, during the pump stroke, to energize to prevent impact of the needle against the valve such that the valve remains seated on the valve seat to prevent flow of fuel within the second chamber to the first chamber. Additionally, the plunger is operable, during the pump stroke, to move within the third chamber to open the check valve and pump the fluid within the third chamber into the fourth chamber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
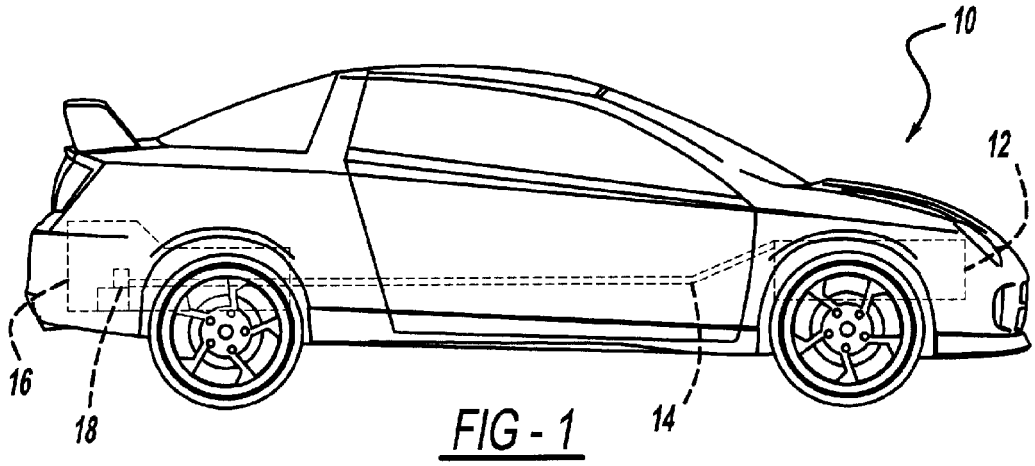
FIG. 1 is a side view of a vehicle depicting a fuel system controlled by a method of operation in accordance with the present disclosure.
Figure 2:
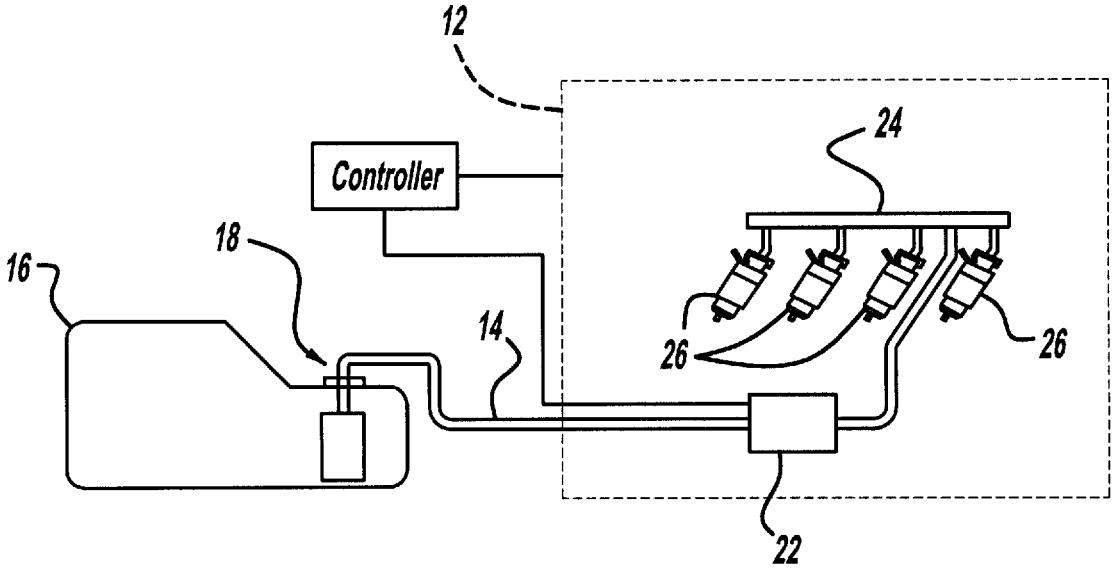
FIG. 2 is a side view of the vehicle fuel system of FIG. 1, depicting fuel injectors, a common rail, and a direct injection fuel pump controlled by a method of operation in accordance with the present disclosure.
Figure 3:
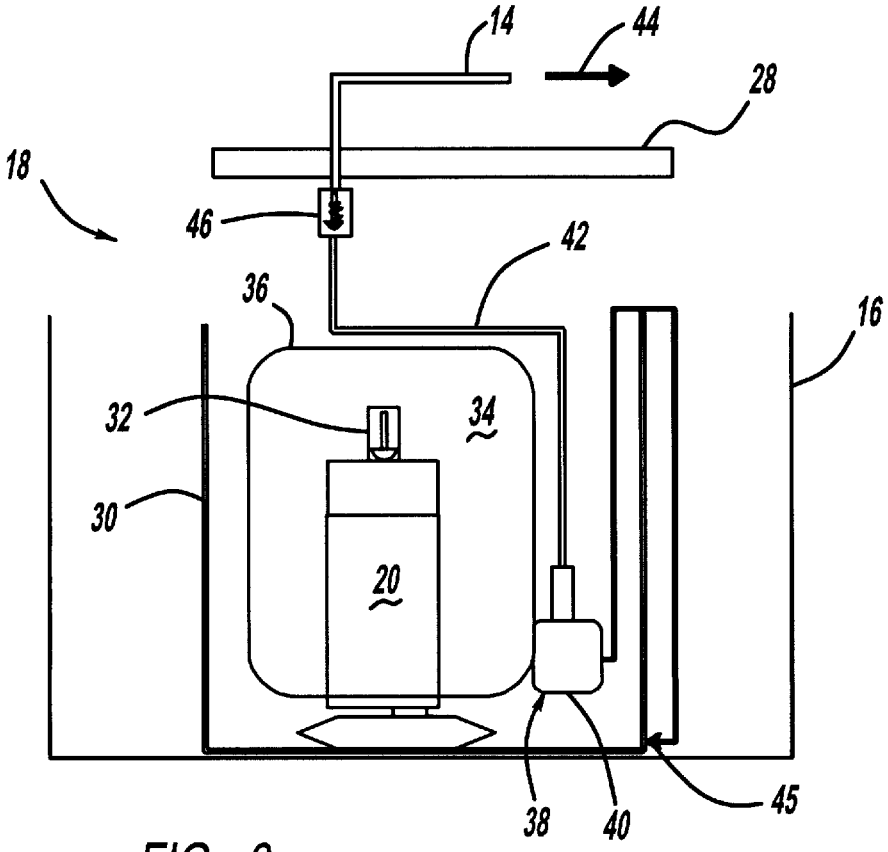
FIG. 3 is a side view of the fuel system fuel pump module of FIG. 2 in accordance with the present disclosure.

Example structural embodiments and methods of control will now be described more fully with reference to FIGS. 1-12 of the accompanying drawings. With reference first to FIGS. 1-3, a vehicle 10, such as an automobile, is depicted having an engine 12, a fuel supply line 14, a fuel tank 16, and a fuel pump module 18. Fuel pump module 18 may mount within fuel tank 16 with a flange and may be submerged in or surrounded by varying amounts of liquid fuel within fuel tank 16 when fuel tank 16 possesses liquid fuel. An electric fuel pump 20 within fuel pump module 18 may pump fuel from fuel tank 16 to a direct injection fuel pump 22 through fuel supply line 14. Upon reaching direct injection fuel pump 22, liquid fuel may then be further pressurized before being directed into common rail 24 from which fuel injectors 26 receive fuel for ultimate combustion within combustion cylinders of engine 12. FIG. 3 depicts but one example of a fuel pump module that may be positioned within fuel tank 16. More specifically, fuel pump module 18 may have a fuel pump module flange 28 may reside on a top surface of fuel tank 16 when fuel pump module 18 is in its installed position.

Continuing with FIG. 3, fuel pump module 18 includes a electric fuel pump 20 which may draw fuel from a reservoir 30 and then pump the fuel through a fuel pump check valve 32 and a fuel filter 34 surrounding electric fuel pump 20. Fuel pump check valve 32 opens in response to fuel pressure from electric fuel pump 20 to permit fuel to flow from the top and out of electric fuel pump 20 and into filter 34. In this manner, fuel pump check valve 32 permits fuel to be pumped from electric fuel pump 20 while preventing fuel from flowing in the opposite direction, that is, into the electric fuel pump 20, when electric fuel pump 20 is not pumping, for example. Fuel pressure is maintained within and through the filter 34 disposed around the electric fuel pump 20, but within a fuel filter case 36. Fuel is pumped into filter 34 and forced through filter 34 toward the bottom of reservoir 30 where the fuel passes through a hole and into a pressure regulator 38, which may be disposed within a pressure regulator case 40. The pressure regulator case 40 may be attached to fuel filter case 36, or integrally formed with fuel filter case 36. Pressure regulator 38 is in fluid communication with the fuel supply line 14 via a feed line 42. Pressure regulator 38 may regulate fuel pressure in feed line 42 and fuel supply line 14. Fuel that passes from pressure regulator 38 flows into and through feed line 42 toward flange 28. Flowing fuel, represented by arrow 44, is fuel that is pumped from electric fuel pump 20, through check valve 32 and to engine 12.

Pressure regulator 38, in addition to passing fuel into feed line 42 at the desired pressure in accordance with the reference setting pressure of pressure regulator 38, re-circulates excess fuel, beyond that which is needed to maintain a reference pressure, back into reservoir 30 so that it again may be drawn into electric fuel pump 20. Relatively low pressure fuel, or rather that pressure to which pressure regulator 38 is manufactured, is also routed from pressure regulator 38 to a jet pump 45, which may be disposed near or at the bottom of fuel tank 16, as depicted in FIG. 3. A fuel supply line check valve 46 may be calibrated to open in response to fuel pressure in feed line 42 when fuel pressure in feed line 42 is at or above a reference pressure to allow fuel to flow from pressure regulator 38, through feed line 42, and into the fuel supply line 14. The pressure required to open the check valve 46 may vary with engine applications, for example.

Figure 4:
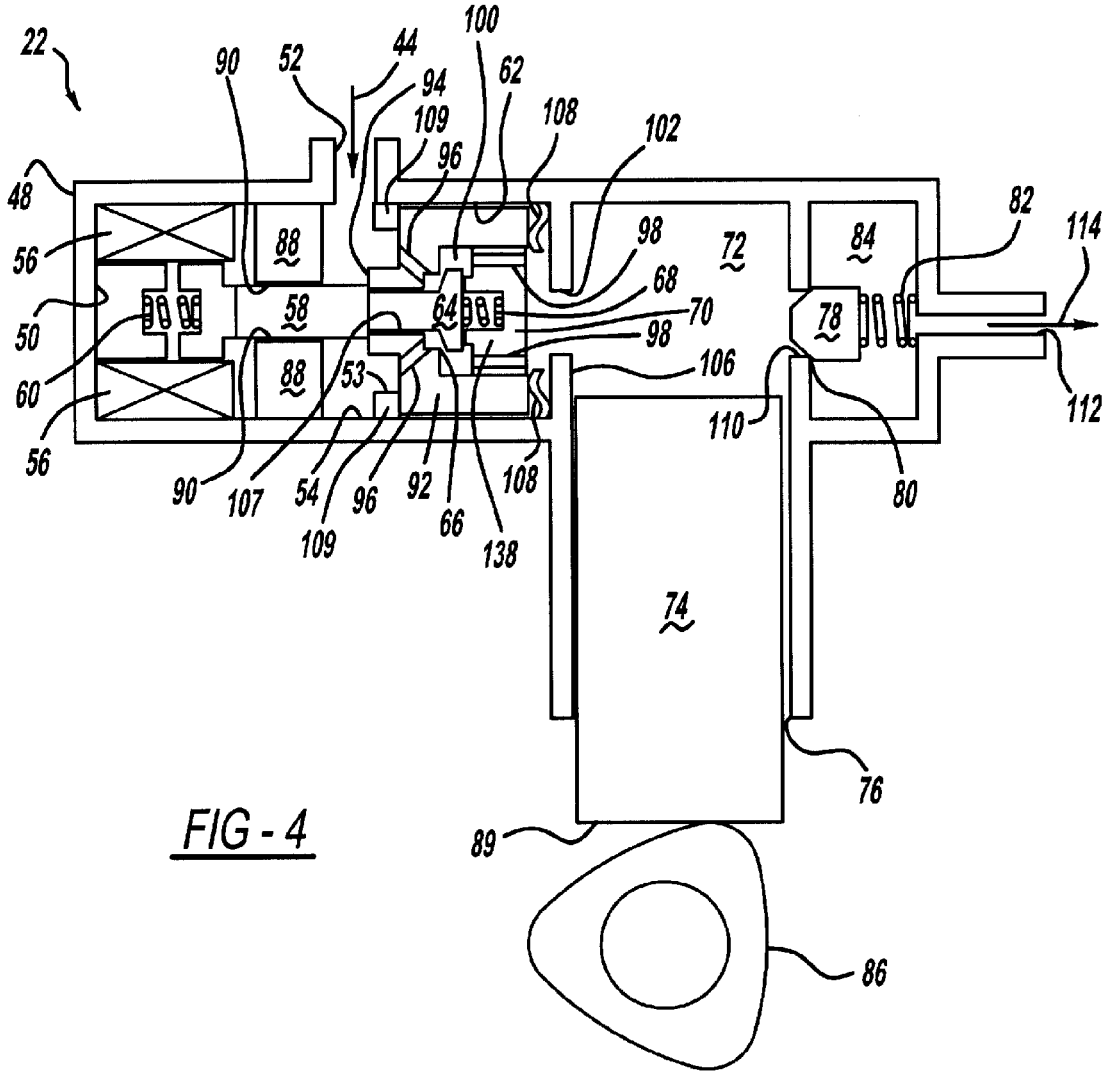
FIG. 4 is a cross-sectional view of a direct injection fuel pump in accordance with the present disclosure.

With reference now including FIG. 4, structure and an associated method of controlling direct injection fuel pump 22, by an engine controller or pump controller for example, will be presented. Direct injection fuel pump 22 may include an outer casing 48 (i.e., overall casing or pump casing) that generally defines an internal cavity 50 that defines other, smaller cavities and houses a variety of structures and parts that operate to pressurize and control fuel passing through direct injection fuel pump 22. Specifically, the casing 48 can define a first chamber 54, a second chamber 62, a third chamber 72, and a fourth chamber 84, and the pump 22 can pump fuel (or other fluid) through the chambers 54, 62, 72, 84 in a manner to be discussed in detail.

Liquid fuel, such as gasoline, may flow through fuel supply line 14, which may be connected to or ultimately lead to an inlet 52 of direct injection fuel pump 22. Fuel flowing in accordance with arrow 44 may pass through inlet 52 and enter the first chamber 54. A solenoid coil 56, a needle 58, and a needle spring 60 can be disposed within the first chamber 54. The needle spring 60 can biases against an end of needle 58, and the needle 58 can be movably disposed within the first chamber 54. The spring 60 can bias the needle 58 toward the second chamber 62 as will be discussed. It will be appreciated that the needle 58 could be biased by another biasing member other than the spring 60 without departing from the scope of the present disclosure.

A suction valve carriage 92 can be movably disposed within the second chamber 62, and a suction valve 64 can be movably disposed within an internal cavity 100 of the carriage 92. The cavity 100 can be partially defined by an internal stop 138 as shown. The valve 64 can cooperate or work in conjunction with needle 58 and engage and disengage (i.e., seat and unseat) valve seat 66 to govern the flow of fuel through direct injection fuel pump 22. Suction valve 64 may be biased with a spring 68 toward the first chamber 54 and toward the needle 58. The spring 68 can bias against wall 70 of the internal stop 138 of the carriage 92. It will be appreciated that the valve 64 could be biased by another biasing member other than the spring 68 without departing from the scope of the present disclosure.

Upon suction valve 64 becoming unseated from valve seat 66, fuel can pass into the third chamber 72, which may be a pressurization chamber 72, where plunger 74, whose outside diameter creates a seal yet permits sliding with internal diameter or surface 76, pressurizes fuel to a desired pressure. Output pressure from pressurization chamber 72 is dependent upon the required output pressure of an internal combustion engine application. To assist in regulating output pressure, an outlet check valve 78 may seat and unseat from valve seat 80 in the fourth chamber 84 in accordance with a spring constant of spring 82. To further facilitate pressurization of fuel in pressurization chamber 72, an end 89 of plunger 74 can ride upon or contacts lobe(s) of a cam 86, which may be directly or indirectly driven by rotation of engine 12. Therefore, different plunger lengths and quantity of cam lobes may affect pressurization of fuel within chamber 72.

Continuing with FIG. 4, needle 58 may contact and be guided by a needle guide 88, which may have needle guide ends 90 that contact needle 58. Moreover, needle guide may be annular and have an inside diameter that contacts needle 58.

The suction valve carriage 92 can have an open end 94 (i.e. sleeve opening) through which an end of the valve 64 is exposed and through which the valve 64 can partially project. Suction valve carriage 92 may have one or more fluid inlet passages 96 (first fluid passages) and one or more fluid outlet passages 98 (second fluid passages) that allow flow of the fluid into and out of the cavity 100 of the carriage 92. For instance, fluid inlet passages 96 may permit fluid passage from first chamber 54 to a suction valve internal cavity 100 while fluid outlet passages 98 may permit fluid passage from suction valve internal cavity 100 to a third chamber inlet 102 for passage of fluid into third chamber 72.

Suction valve carriage 92 may be movable within second chamber 62 between a fixed stop or wall 109, which separates first chamber 54 and second chamber 62, and a suction valve carriage damper 108. The damper 108 can be an annular-shaped spring or other device that dampens shock forces, vibrational loads, etc. Suction valve carriage damper 108 may reside between suction valve carriage 92 and a wall 106 that defines third chamber inlet 102. As shown, suction valve carriage damper 108 may reside outside of suction valve carriage 92 and within second chamber 62, while spring 68 may reside inside, or completely contained and surrounded by suction valve carriage 92 as an internal spring 68 of suction valve carriage 92.

As mentioned above, third chamber 72 may be a pressurization chamber, and fourth chamber 84 may be an exit chamber for fluid exiting direct injection fuel pump 22. Plunger 74 may move into and out of, and toward and away from, third chamber 72 to pressurize fluid in third chamber 72. Outlet check valve 78 may work in conjunction with outlet check valve spring 82 to cover and uncover inlet 110 into fourth chamber 84. Outlet check valve spring 82 may bias to permit fluid to enter fourth chamber 84 and subsequently from fourth chamber 84 via pump outlet 112 as exit fuel 114.

Figure 5:
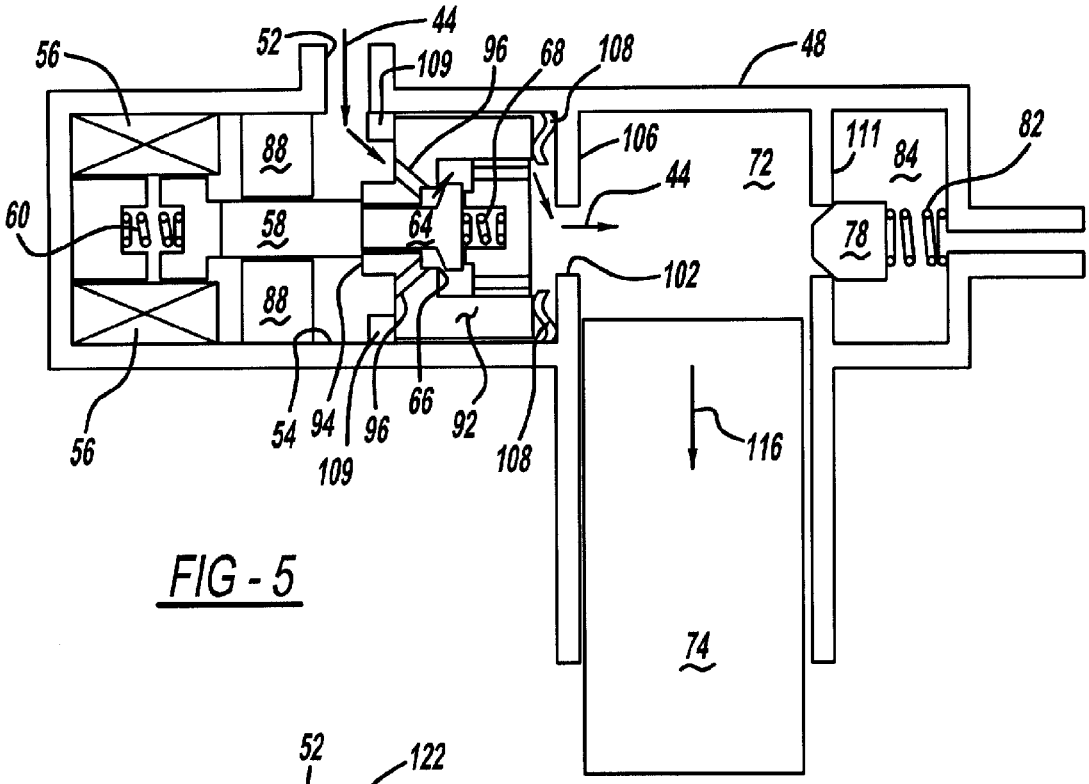
FIGS. 5-7 are cross-sectional views of a direct injection fuel pump depicting a plunger, a needle valve, a suction valve and associated pump structures in accordance with the present disclosure.
Figure 6:
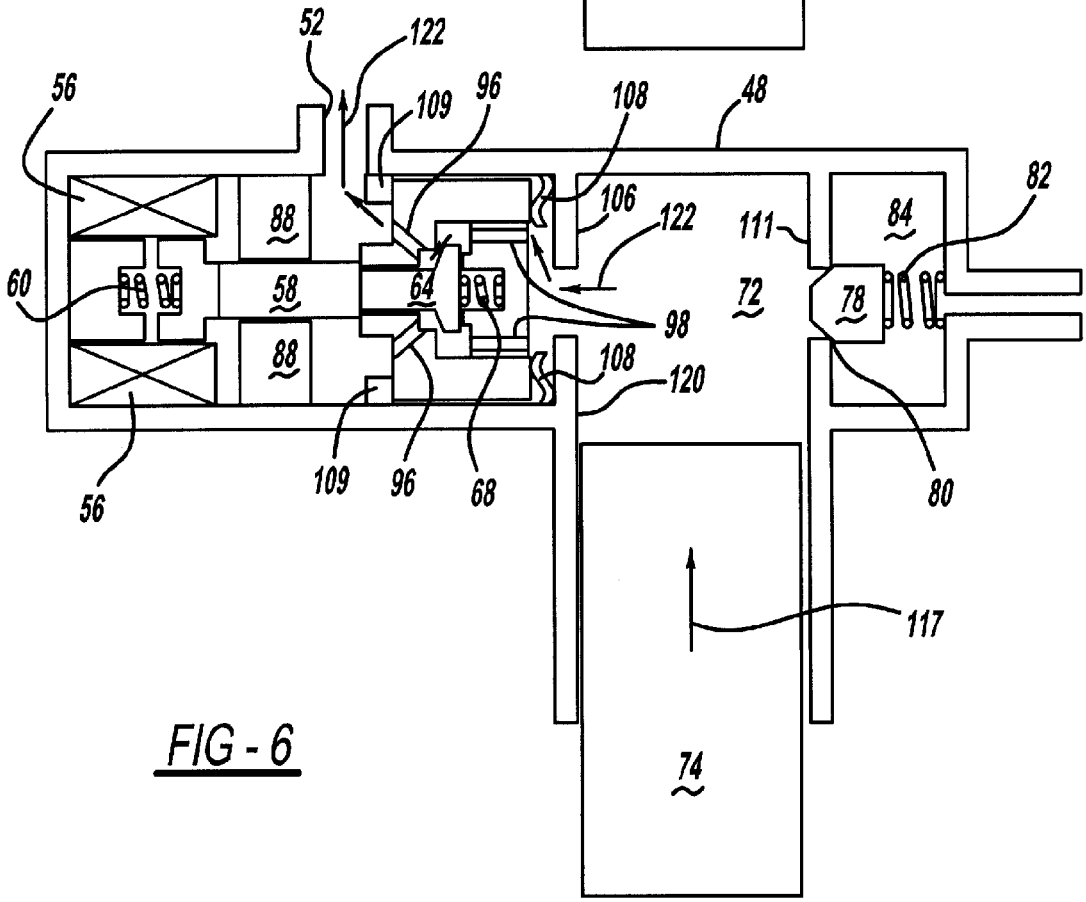
Figure 7:
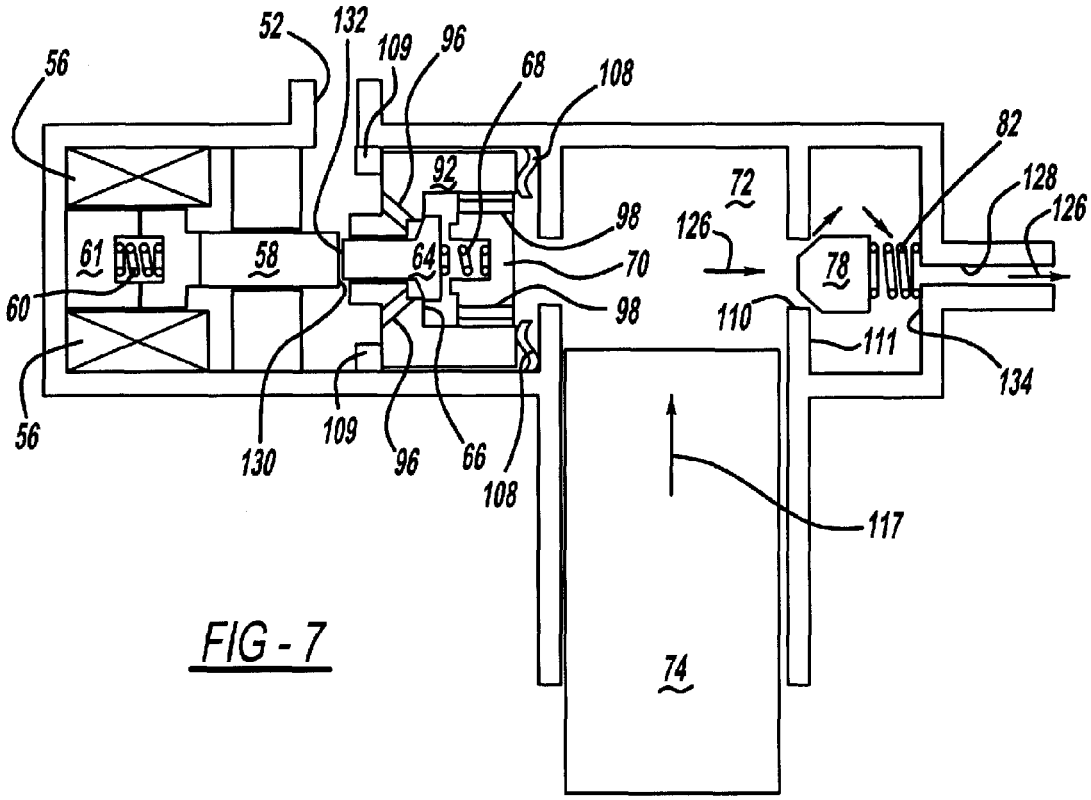
Figure 8:
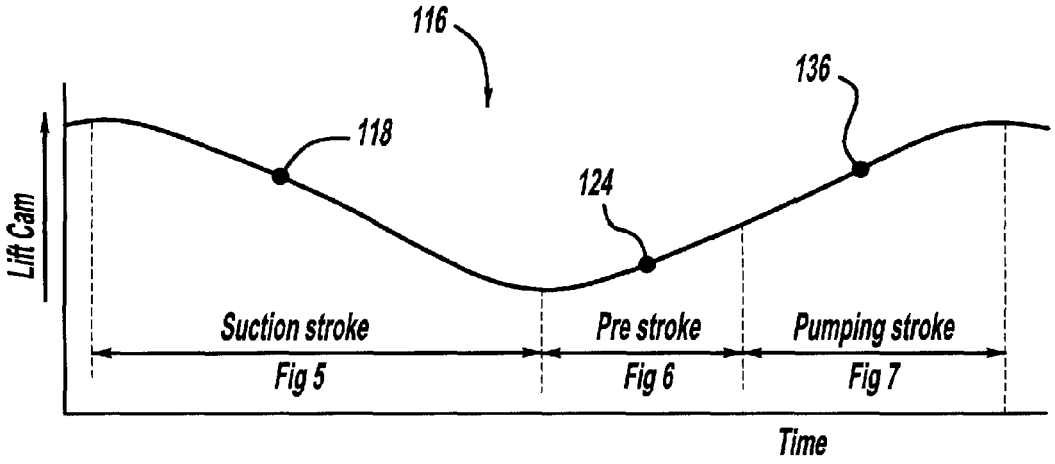
FIG. 8 is a graph depicting different strokes of the direct injection fuel pump relative to cam positions in accordance with the present disclosure.

Turning now to FIGS. 5-7, and with reference to FIG. 8, more specific control of direct injection fuel pump 22 will be described in accordance with the present disclosure. Operation of the pump 22 can be discussed in relation to a plurality of "strokes" of the pump 22, exemplary embodiments of which are represented in FIGS. 5-8.

For instance, the pump 22 can have a suction stroke represented in FIG. 5, wherein fuel enters first chamber 54 in accordance with arrow 44. With solenoid coil 56 de-energized, or turned off and with downward movement of plunger 74 (i.e. movement away from pressurization chamber 72), a suction force between inlet 52 through to pressurization chamber 72 is created due to a vacuum that forms and continues as plunger 74 moves away from pressurization chamber 72. At the same time, check valve 78 may be seated against and form a seal with valve seat 80 as plunger 74 moves in accordance with arrow 117, away from pressurization chamber 72. Force of spring 82 facilitates seating of check valve 78 against seat 80 during a suction stroke of plunger 74 to draw fluid into pressurization chamber 72. Vacuum created within pressurization chamber 72 also draws check valve toward seat 80. Thus, FIG. 5 depicts a scenario in which solenoid coil 56 is electrically de-energized so that fuel may be drawn into pressurization chamber 72 by plunger 74. As depicted in FIG. 8, the position of plunger 74 of suction stroke of FIG. 5 may coincide with decreasing or lessening cam lift, such as at position 118 of curve 116.

When solenoid coil 56 is de-energized, needle spring 60 is able to force (bias) needle 58 away from solenoid coil 56 such that needle 58 contacts (abuts or impacts) the portion of the valve 64 projecting from the carriage 92, thereby advancing the valve 64 further into the carriage 92 against the biasing force supplied by the spring 68. After initially contacting the valve 64, the needle 58 further moves toward and eventually impacts (contacts or abuts) an end surface 94 of the open end of suction valve carriage 92 and biases an opposite end of suction valve carriage 92 against suction valve carriage damper 108 thereby compressing suction valve carriage damper 108.

As spring 68 compresses, suction valve 64 moves within suction valve carriage 92 and unseats from valve seat 66 to permit fuel to flow past suction valve 64 and into pressurization chamber 72. Fuel flow (shown by arrows 44) is facilitated or hastened due to suction created by plunger 74 moving downward in accordance with arrow 116.

With reference to FIG. 6, a pre-stroke, also known as a pre-pressurization stroke and a low pressure return stroke, is depicted and occurs when plunger 74 begins to move upward in accordance with arrow 117 within a cylinder or sleeve 120. As depicted in FIG. 6, a pre-stroke phase constitutes a movement in which cam 86 (FIG. 4) is in the process of lifting plunger 74; however, fuel is able to flow in reverse through direct injection fuel pump 22 in accordance with arrows 122 for a short period of time, and thus, fuel is not yet pressurized to an injection pressure in pressurization chamber 72. Thus, FIG. 6 represents a pumping scenario when solenoid coil 56 is off or de-energized, suction valve 64 is not seated against valve seat 66 and fuel is able to flow from pressurization chamber 72 through direct injection fuel pump 22 and out of casing inlet or pump inlet 52 as plunger 74 initially moves toward pressurization chamber 72, such as just after a bottom dead center ("BDC") position of plunger 74. Exit check valve 78 may be seated against valve seat 80 during pre-stroke of FIG. 6 as force of exit check valve spring 82 forces it against valve seat 80. As depicted in FIG. 8, the position of plunger 74 of pre-stroke stroke of FIG. 6 may coincide with increasing cam lift, such as at position 124 of curve 116.

FIG. 7 depicts a pumping stroke in which plunger 74 moves further upward or toward pressurization chamber 72 in accordance with arrow 117. As plunger 74 moves within sleeve 90, fuel is pressurized within pressurization chamber 72. As depicted in FIG. 7, a pumping stroke phase constitutes a movement in which cam 86 (FIG. 4) is in the process of lifting or moving plunger 74 toward and to a position of top dead center ("TDC") relative to lifting or movement capabilities of cam 86. Fuel is able to flow through direct injection fuel pump 22 and exit pump 22 at pump outlet 128 in accordance with arrows 126 upon fuel being pressurized to a pressure that overcomes a spring force of check valve spring 82. Thus, fuel is pressurized in pressurization chamber 72 and then exits through inlet to exit chamber 84.

Thus, FIG. 7 represents a scenario such that when solenoid coil 56 is on or energized, force of energized solenoid coil 56 attracts needle 58, thereby compressing needle spring 60 and removing needle end 130 from contact with an end 132 of suction valve 64. Thus, spring 68 then biases suction valve 64 against valve seat 66 to prevent fuel from flowing into first chamber or inlet chamber 54 and instead fuel is forced to flow into fourth chamber or exit chamber 84 and from outlet 128.

Continuing with FIG. 7, when fuel is exiting from outlet 128, the force of flowing fuel and/or associated pressure in chamber 72 may be greater than the resistant or compressive force of spring 82 against check valve 78 to permit compression of spring 82 and movement of check valve 78 such that fuel 126 is able to exit from outlet 112. Spring 68 may bias against wall 70 when suction valve 64 is closing and bias suction valve 64 against valve seat 66 to prevent fuel from flowing through fluid inlet passages 96. Similarly, spring 82 may bias against wall 134 when check valve 78 is moving check valve 78 away from valve seat 80 and to valve seat 80 (i.e. opening or closing, respectively).

Thus, FIGS. 5-7 each represent a position of plunger 74, a corresponding status (e.g. on or off) of solenoid coil 56 and an effect of plunger 74 position and solenoid coil 56 status on fuel flow through direct injection fuel pump 22. As depicted in FIG. 8, the position of plunger 74 of pumping stroke of FIG. 7 may coincide with increasing cam lift, such as at position 136 of curve 116.

Figure 9:
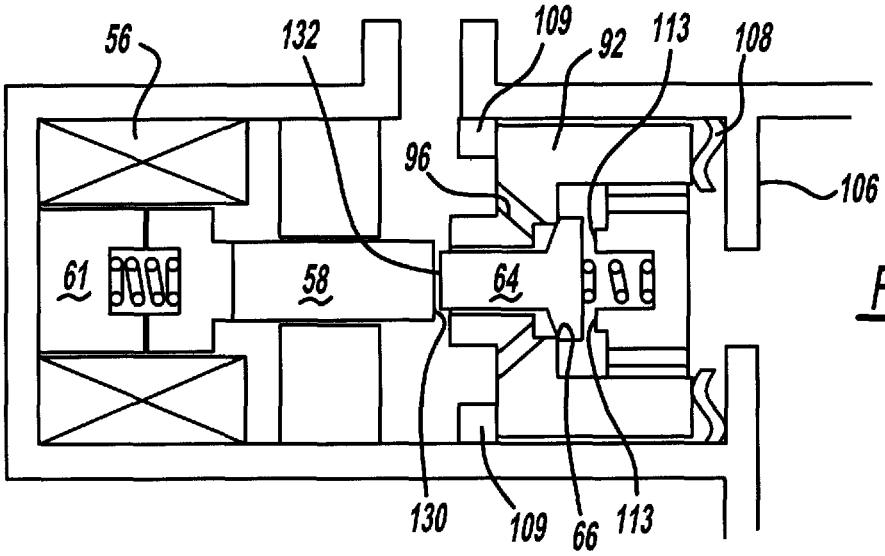
FIGS. 9-11 depict various positions and contact locations of a needle, suction valve, and various physical stop structures of the direct injection fuel pump in accordance with the present disclosure.
Figure 10:
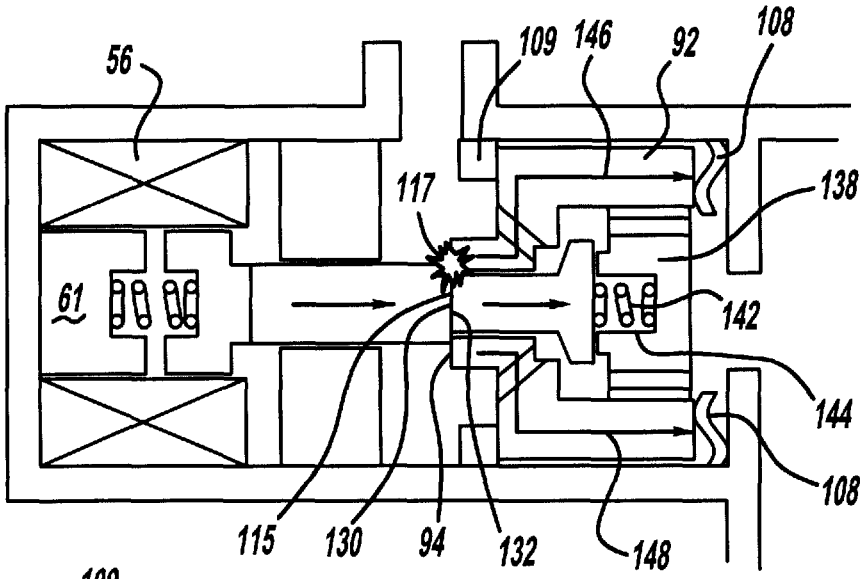
Figure 11:
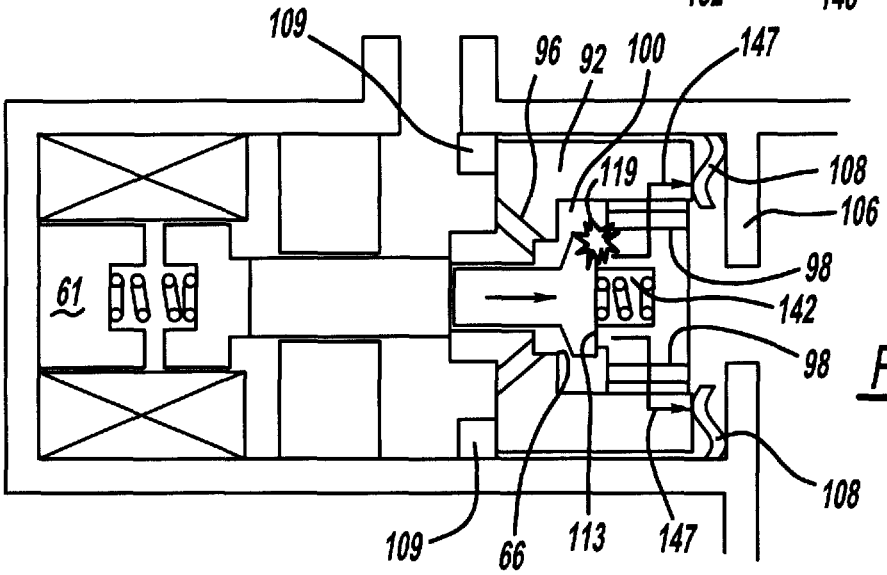

FIGS. 9-11 depict positions of internal components of direct injection fuel pump 22 during the different strokes or phases of operation. FIG. 9 depicts positions of needle 58 and suction valve 64 during a pumping stroke when solenoid 56 is energized, as explained in conjunction with FIG. 7; however, noise due to contact of needle 58 and suction valve 64 does not occur because suction valve 64 is seated against valve seat 80 and solenoid 56 is energized thus drawing needle 58 against spring holder 61, which creates a gap between needle 58 and suction valve 64. This occurs as plunger 74 travels toward a plunger TDC position (FIG. 7). Because the valve 64 is seated on the valve seat 80, no fluid flows through at least fluid inlet passages 96 during the pumping stroke 136.

FIG. 10 depicts a beginning of a downward stroke of plunger 74 (e.g. suction stroke) in which electrical current to solenoid coil 56 is turned off, thus de-energizing solenoid coil 56 and preventing attraction of needle 58 against spring holder 61. The needle 58 breaks physical contact with spring holder 61 and moves toward suction valve 64 due to the force of spring 60 biasing against spring holder 61. Spring 60 may be fixed between or within solenoid coil 56. Thus, spring 60 biases needle 58 to cause an end 130 of needle 58 to move into and strike an end 132 of suction valve 64. As depicted in FIG. 10, when needle 58 strikes suction valve 64, an audible noise may be created. Then, after needle 58 strikes suction valve 64, needle 58 continues to travel toward suction valve carriage 92, and when suction valve 64 moves past an end surface 94 of suction vale carriage 92 so that suction valve 64 is completely and entirely within confines of suction valve carriage 92, the end surface 130 of needle 58 strikes the end surface 94 of suction valve carriage 92. An audible noise may be created by such strike. Also, a shock load or vibration can be generated due to this impact. As shown in FIG. 10, the shock load or vibration (i.e., first load) can be transmitted through the carriage 92 to be dampened by the damper 108 as depicted by arrows 146, 148. The damper 108 can act as a shock absorber to absorb the shock of impact between needle 58 with end surface 94 of suction valve carriage 92. Damper 108 may be flexible and be a spring or perform as a spring to absorb energy from suction valve carriage 92.

FIG. 11 depicts continuation of the suction stroke initiated in FIG. 10 such that fluid may be drawn into fluid inlet passages 96, into suction valve internal cavity 100, into fluid outlet passages 98, and subsequently into pressurization chamber 72. Upon suction valve 64 moving from valve seat 66, suction valve 64 may move toward and strike end surface 113 of internal stop 138 of suction valve carriage 92. Internal stop 138 is part of suction valve carriage 92. Internal stop 138 may define a receptacle for suction valve spring 68. Internal stop 138 may include a cavity 142 defined by and surrounded by a wall 144. Suction valve spring 68 may reside within cavity 142 such that only one end of suction valve spring 68 protrudes beyond an end surface 113 of wall 144. When compressed by suction valve 64, suction valve spring 68 may be compressed within cavity 142 and against wall 70 such that no portion of suction valve spring 68 protrudes beyond an end surface 140 of internal stop 138. When suction valve 64 strikes end surface 113 of internal stop 138 which may lie completely within confines of suction valve carriage 92, vibration and shock loads (i.e., second loads) created by the impact may be transmitted into and through suction valve carriage 92 in accordance with arrows 147 (FIG. 11) and into damper 108, which acts as a shock absorber and absorbs shock of impact between suction valve 64 and end surface 113 of internal stop 138 of suction valve carriage 92. Because damper 108 may be flexible and may be a spring or perform as a spring to absorb energy from suction valve carriage 92, vibration, shock and noise are absorbed or lessened than if damper 108 were to not exist and if suction valve carriage 92 were to directly strike dividing wall 106 that divides and lies between pressurization chamber 72 and exit chamber 84.

A method of controlling the pump 22 may involve providing a first chamber 54 within a chamber casing 48, which defines an inlet 52. The method may also involve providing a first wall 109 that defines a first aperture 53 (FIG. 4) to permit fluid to flow to suction valve carriage 92. First chamber 54 may house a solenoid coil 56 and energization and de-energization of solenoid coil 56 can control movement of needle 58. The method may also involve providing a second chamber 62 within chamber casing 48 with a suction valve 64. The second chamber 62 may be located next to the first chamber 54 and first aperture 53 may define a fluid passageway between first chamber 54 and second chamber 62. The method may further involve providing a third chamber 72 within chamber casing 48 that is open to a sleeve 120, which may be cylindrical, containing a plunger 74. The method may also involve providing a second wall 106 that defines a second aperture 102 as a fluid passageway between second chamber 62 and third chamber 72. The method may also involve providing a fourth chamber 84 with exit valve 78 and a third wall 106 that defines a third aperture 110 between third chamber 72 and fourth chamber 84.

Stated slightly differently, and in accordance with the present disclosure, pump 22 may employ needle 58, suction valve 64, and suction valve carriage 92 within which suction valve 64 may reside and move. In the following order during a suction stroke operation of pump 22, needle 58 may contact suction valve 64, and then needle 58 may contact suction valve carriage 92 (at contact point 117 of FIG. 10) to transmit shock via arrows 146, 148 through suction valve carriage 92 and to suction valve carriage damper 108. Subsequently, suction valve 64 may contact internal stop 138 of suction valve carriage 92 (at contact point 119 of FIG. 11) to transmit shock via arrows 147 from surface 113 through internal stop 138 of suction valve carriage 92 and through a balance of suction valve carriage 92 to suction valve carriage damper 108.

Pump 22 may further employ a pump casing 48, which may be an outer casing, defining a first chamber 54 and a solenoid coil 56 residing within first chamber 54. Pump casing 48 may define a second chamber 62, and suction valve carriage 92 may reside within second chamber 62 against suction valve carriage damper 108, and post, circular ring, holder, or wall 109. Pump casing 48 may also define third chamber 72 and wall 106 may demarcate a division between second chamber 62 and third chamber 72. Suction valve carriage damper 108 may reside between suction valve carriage 92 and wall 106 that demarcates the division between second chamber 62 and third chamber 72. Suction valve carriage 92 may define first fluid passageway 96 that permits fluid from outside of the suction valve carriage to pass to a cavity 100 within the suction valve carriage 92. (Fluid may also flow in a reverse direction depending upon a stroke of plunger 74.) Suction valve carriage 92 may further define second fluid passageway 98 that permits fluid from cavity 100 within suction valve carriage 92 to pass outside of suction valve carriage 92. Suction valve 64 may control passage of fluid from first fluid passageway 96 into cavity 100. Suction valve carriage damper 108 may contact (e.g. flex in a spring-like or cantilever fashion) suction valve carriage 92 to dampen shock of needle 58 striking end surface 94 of suction valve carriage 92, shock of needle 58 striking suction valve 64. Suction valve spring 68 may reside within internal stop 138 of suction valve carriage 92 and may be compressible from beyond an end surface 94 of internal stop 138 of suction valve carriage 92 to be flush with end surface 94 of internal stop 138 of suction valve carriage 92. Plunger 74 may reside within third chamber 72 defined by pump casing 48 and third chamber 72 may be fluidly linked to second chamber 62. Outlet check valve 78 may be located in fourth chamber 84 defined by pump casing 48 and fourth chamber 84 may be fluidly linked to third chamber 72.

Suction valve carriage 92 may define a sleeve 107 (FIG. 4) into fluid reservoir 100 and suction valve 64 may partially reside within sleeve 107 and partially protrude beyond end surface 94 of suction valve carriage 92. A width (e.g., diameter) of needle 58 may be greater than a width (e.g. inside diameter) of the opening of the sleeve 107 (i.e., the sleeve opening). Thus, suction valve carriage 92 may be a stop for needle 58 (i.e., limit movement of the needle 58 relative to the carriage 92. Wall 106 may divide second chamber 62 and third chamber 72, and suction valve carriage damper 108 may reside between suction valve carriage 92 and wall 106 that divides second chamber 62 and third chamber 72.

In another arrangement, a pump 22 may employ first chamber 54 within chamber casing 48, and a wall 106 may define a first aperture 102. First chamber 54 may house solenoid coil 56, which may control fore and aft movement of needle 58. Pump 22 may employ second chamber 62 within chamber casing 48 with suction valve carriage 92 that contains movable suction valve 64. A first wall 109 may define a first aperture 53 and may permit passage of fluid between first chamber 54 and second chamber 62. Third chamber 72 may be defined within chamber casing 48 and may be open to a sleeve 107 containing plunger 74. Second wall 106 may define a second aperture 102 as a fluid passageway between second chamber 62 and third chamber 72. Fourth chamber 84 may house an exit valve 78 and third wall 111 may define third aperture 110 between third chamber 72 and fourth chamber 84. During operation of pump 22 the following may take place in order: a) needle 58 and suction valve 64 may contact each other; b) needle 58 and suction valve carriage 92 may contact each other; and c) suction valve 64 may contact internal stop 138 of suction valve carriage 92.

It is possible that the following contacts occur in the following order with reference to FIGS. 9-11: a) end surface 130 of needle 58 contacts end surface 132 of suction valve 64; b) end surface 130 of needle 58 contacts end surface 94 of suction valve carriage 92; and c) an end surface of suction valve 64 contacts end surface 113 of internal stop 138 of suction valve carriage 92.

A vibration path through solid material is defined from suction valve carriage 92 into suction valve carriage damper 108 upon needle 58 contacting suction valve carriage 92, and subsequently upon suction valve 64 contacting and end surface 113 of internal stop 138 of suction valve carriage 92. Because two separate impacts occur, noise from pump 22 may be lower than if one object with a larger mass (e.g. a combination of needle 58 and suction valve 64 abut together and travel together as a single unit) impacts the end surface 113 of the internal stop 138.

Figure 12:
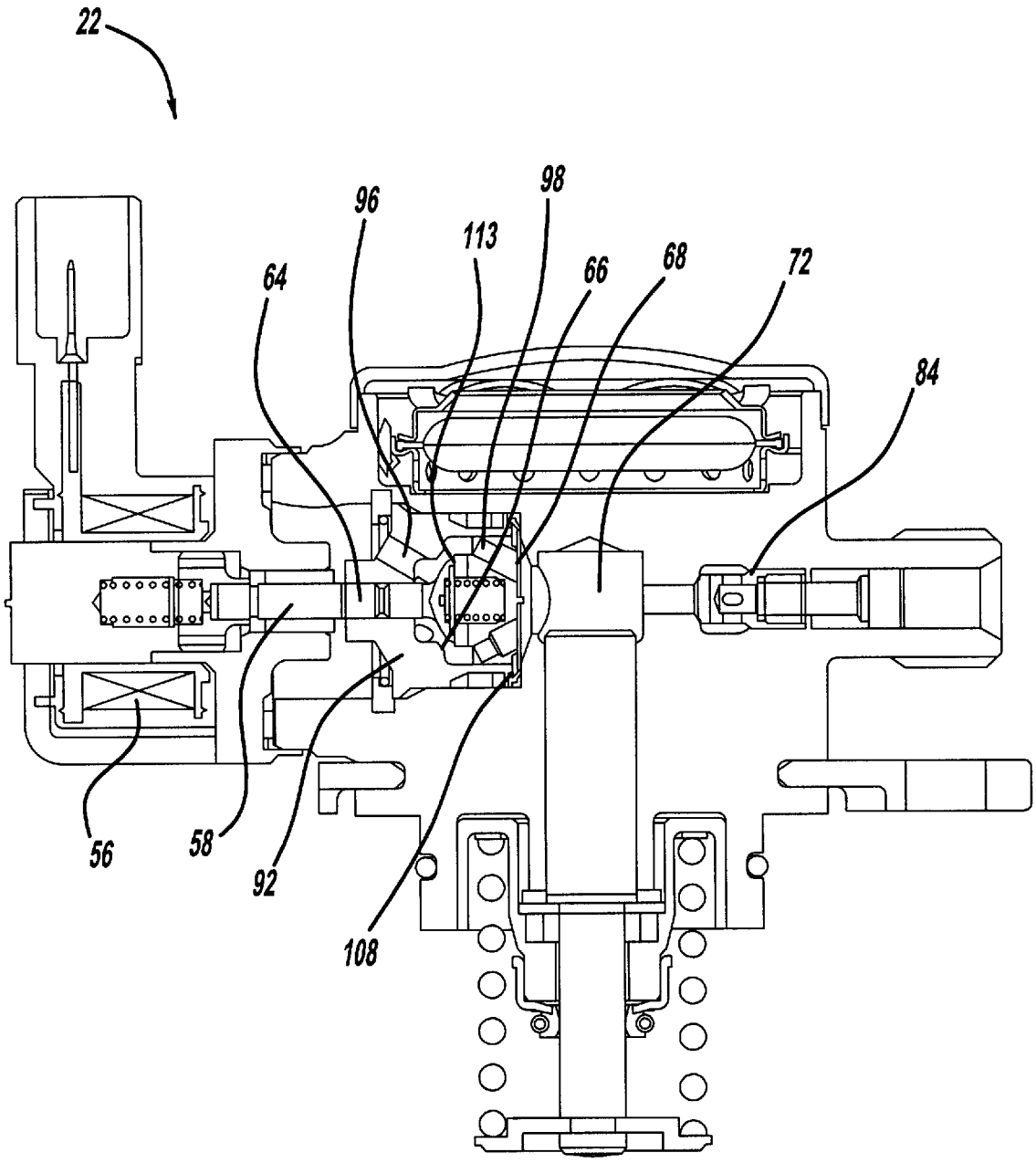
FIG. 12 depicts a cross-sectional view of an embodiment in accordance with the present disclosure.

FIG. 12 depicts a cross-sectional view of an embodiment in accordance with the present disclosure. Corresponding reference numerals indicate corresponding parts throughout the several views of the drawings.

An advantage of the present disclosure is that by constructing direct injection fuel pump 22 so that multiple strikes occur in succession between parts with relatively masses (such as when needle 58 strikes suction valve 64, end surface 130 of needle 58 strikes end surface 94 of suction valve carriage 92, and suction valve 64 strikes end surface 140 of internal stop 138 of suction valve carriage 92), instead of fewer strikes with larger masses, noise levels due to the impacts may be lessened, thereby making overall pump operation quieter. Additionally, teachings of the present disclosure may be successfully applied to an engine operating at any RPM.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A pump having a stroke for moving a fluid comprising:

a pump casing defining a first chamber and a second chamber, the fluid moving from the first chamber to the second chamber during the stroke;

a needle that is movably disposed in the first chamber;

a valve carriage that is movably disposed in the second chamber, the valve carriage including an internal stop, the valve carriage also including a cavity therein that is partially defined by the internal stop; and a valve that is movably disposed within the cavity of the valve carriage, the valve operable to be impacted by the needle during the stroke, the needle operable to impact the valve carriage during the stroke, and the valve operable to impact the internal stop during the stroke at a time different from the needle impacting the valve carriage.

2. The pump according to claim 1, further comprising a solenoid coil that is disposed within the first chamber, wherein energization and deenergization of the solenoid coil selectively causes movement of the needle.

3. The pump according to claim 1, further comprising a needle biasing member that biases the needle toward the valve.

4. The pump according to claim 1, further comprising a valve carriage damper operable to dampen at least one of a first load resulting from the needle impacting the valve carriage and a second load resulting from the valve impacting the internal stop.

5. The pump according to claim 4, wherein the pump casing defines a third chamber, the pump further comprising a wall that demarcates a division between the second chamber and the third chamber, the valve carriage damper being disposed between the valve carriage and the wall.

6. The pump according to claim 4, wherein the valve carriage damper is operable to dampen both the first and second loads.

7. The pump according to claim 1, wherein the valve carriage further defines at least one fluid passageway for movement of the fluid into and out of the cavity of the valve carriage.

8. The pump according to claim 7, wherein the at least one fluid passageway includes a first fluid passageway allowing flow of the fluid from outside the valve carriage into the cavity during the stroke and a second fluid passageway allowing flow of the fluid from inside the cavity to outside the cavity during the stroke.

9. The pump according to claim 7, wherein the at least one fluid passageway includes a valve seat, the valve selectively seating on and unseating from the valve seat to thereby control flow of the fluid through the at least one fluid passageway.

10. The pump according to claim 9, further comprising a valve biasing member that applies a biasing load on the valve toward a position in which the valve is seated on the valve seat, the impact of the needle against the valve moving the valve against the biasing load to unseat the valve from the valve seat.

11. The pump according to claim 10, wherein the valve carriage includes a sleeve opening through which the valve projects, wherein impact of the needle against the valve advances the valve into the sleeve opening and into the cavity.

12. The pump according to claim 11, wherein the needle has a needle width, and wherein the sleeve opening has a sleeve opening width, the needle width being larger than the sleeve opening width such that, after impacting the valve and advancing the valve into the sleeve opening and cavity, the needle impacts the valve carriage.

13. A pump having a suction stroke for moving a fluid comprising:

a pump casing defining a first chamber and a second chamber, the fluid moving from the first chamber to the second chamber during the suction stroke;

a needle that is movably disposed in the first chamber;

a valve carriage that is movably disposed in the second chamber, the valve carriage including an internal stop, the valve carriage also including a cavity therein that is partially defined by the internal stop, a sleeve opening defined in the valve carriage and providing access to the cavity;

a fluid passageway defined through the valve carriage, the fluid passageway including a valve seat; and a valve that is movably disposed within the cavity to seat on and unseat from the valve seat to control flow of the fluid into the cavity, the valve operable to protrude partially from the sleeve opening, the needle operable, during the suction stroke, to move toward the valve and the valve carriage and eventually impact the valve, the needle operable, during the suction stroke and after impacting the valve, to advance the valve into the cavity and unseat the valve from the valve seat, the needle operable, during the suction stroke and after unseating the valve from the valve seat, to impact the valve carriage, and the valve operable, during the suction stroke and after the needle impacts the valve carriage, to advance further into the cavity and impact the internal stop.

14. The pump according to claim 13, further comprising a valve carriage damper operable to dampen both of a first load resulting from the needle impacting the valve carriage and a second load resulting from the valve impacting the internal stop.

15. The pump according to claim 13, further comprising a valve biasing member that applies a biasing load on the valve toward a position in which the valve is seated on the valve seat, the impact of the needle against the valve moving the valve against the biasing load to unseat the valve from the valve seat.

16. The pump according to claim 13, wherein the needle has a needle width and the sleeve opening having a sleeve opening width, the needle width being larger than the sleeve opening width such that, after impacting the valve and advancing the valve into the sleeve opening and cavity, the needle impacts the valve carriage.

17. The pump according to claim 13, wherein the pump casing further defines a third chamber that is fluidly connected to the second chamber, and further comprising a plunger that is movably disposed within the third chamber, the plunger moving within the third chamber during the suction stroke such that the fluid moves from the first chamber, into the second chamber, and into the third chamber.

18. The pump according to claim 17, wherein the pump casing further defines a fourth chamber that is fluidly connected to the third chamber, and further comprising a check valve that controls flow of the fluid from the third chamber to the fourth chamber.

19. The pump according to claim 18, wherein the pump further includes a pump stroke, and further including a solenoid that is operable, during the pump stroke, to energize to prevent impact of the needle against the valve such that the valve remains seated against the valve seat to prevent flow of fluid within the second chamber to the first chamber, the plunger operable, during the pump stroke, to move within the third chamber to open the check valve and pump the fluid within the third chamber into the fourth chamber.

20. A vehicle fuel pump having a suction stroke and a pump stroke for moving a fuel comprising:

a pump casing defining a first chamber, a second chamber, a third chamber, and a fourth chamber;

a needle that is movably disposed in the first chamber and that is biased toward the second chamber, movement of the needle being selectively controlled by a solenoid;

a valve carriage that is movably disposed in the second chamber, the valve carriage including an internal stop, the valve carriage also including a cavity therein that is partially defined by the internal stop, a sleeve opening defined within the valve carriage and providing access to the cavity;

a first fluid passageway defined through the valve carriage, the first fluid passageway including a valve seat;

a second fluid passageway defined through the internal stop;

a valve that is movably disposed within the cavity and that is biased to seat against the valve seat and to protrude partially from the sleeve opening;

a plunger that is movably disposed within the third chamber; and a check valve that controls flow from the third chamber to the fourth chamber;

the needle operable, during the suction stroke, to move toward the valve and the valve carriage and eventually impact the valve, the needle operable, during the suction stroke, to advance the valve into the cavity and unseat the valve from the valve seat after impacting the valve, the needle operable, during the suction stroke, to impact the valve carriage after unseating the valve from the valve seat, the valve operable, during the suction stroke, to advance further into the cavity and impact the internal stop after the needle impacts the valve carriage, the plunger operable, during the suction stroke, to move within the third chamber to draw fuel along a flow path extending from the first chamber, through the first fluid passageway, through the cavity, through the second fluid passageway, and into the third chamber, the check valve operable, during the suction stroke, to prevent flow of fuel from the third chamber into the fourth chamber, the solenoid operable, during the pump stroke, to energize to prevent impact of the needle against the valve such that the valve remains seated on the valve seat to prevent flow of fuel from within the second chamber to the first chamber, and the plunger operable, during the pump stroke, to move within the third chamber to open the check valve and pump the fluid within the third chamber into the fourth chamber.

* * * * *